US011988207B2

(12) United States Patent
Olenych

(10) Patent No.: US 11,988,207 B2
(45) Date of Patent: May 21, 2024

(54) SEALING SYSTEM FOR A ROTARY-PISTON COMPRESSOR

(71) Applicant: RPC ENGINEERING LIMITED LIABILITY COMPANY, Moscow (RU)

(72) Inventor: Maksym Victorovich Olenych, Noviy gorodok (RU)

(73) Assignee: RPC ENGINEERING LIMITED LIABILITY COMPANY, Moscow (RU)

( * ) Notice: Subject to any disclaimer, the term of this patent is extended or adjusted under 35 U.S.C. 154(b) by 0 days.

(21) Appl. No.: 17/426,016

(22) PCT Filed: Jan. 28, 2019

(86) PCT No.: PCT/RU2019/000049
§ 371 (c)(1),
(2) Date: Jul. 27, 2021

(87) PCT Pub. No.: WO2020/159394
PCT Pub. Date: Aug. 6, 2020

(65) Prior Publication Data

US 2022/0136505 A1 May 5, 2022

(51) Int. Cl.
*F03C 2/00* (2006.01)
*F01C 19/00* (2006.01)
(Continued)

(52) U.S. Cl.
CPC ..... *F04C 18/22* (2013.01); *F01C 19/005* (2013.01); *F01C 19/10* (2013.01); *F04C 27/002* (2013.01)

(58) Field of Classification Search
CPC ..... F01C 19/005; F01C 19/02; F01C 19/10; F01C 21/08; F04C 18/22; F04C 27/002; F04C 27/003; F02B 2053/005
See application file for complete search history.

(56) References Cited

U.S. PATENT DOCUMENTS 3,179,331 A * 4/1965 Paschke ..... F01C 19/10 418/142
3,794,450 A * 2/1974 Klomp ..... F01C 19/02 418/117
(Continued)

FOREIGN PATENT DOCUMENTS

DE 2521049 A1 * 11/1976 ..... F01C 19/005
GB 2557946 7/2018
(Continued)

OTHER PUBLICATIONS

WO2012/023916A1—Olenich, Maksim Viktorovich—Rotary Piston Compressor—Feb. 23, 2012—the English Machine Translation (Year: 2012).*
(Continued)

*Primary Examiner* — Theresa Trieu
(74) *Attorney, Agent, or Firm* — Nixon & Vanderhye PC

(57) ABSTRACT

Rotary piston machines working volume sealing systems thereof are disclosed. They can be used in gas (air) and refrigerating compressors, heat and vacuum pumps, and internal-combustion engines. The rotary piston compressor sealing system includes radial and butt sealing bars in the rotor slots, tightened towards the working surfaces by expanders and interacting with the sealing cylinders. The radial and butt sealing bars are made from an antifriction composite material. Each sealing cylinder is configured conjointly with one end of one butt sealing bar. Variations also are disclosed. The technical result involves increasing efficiency of the sealing system and the whole compressor operation, simplification of the system production process, simplification and labor intensity reduction of the system assembly and maintenance, increasing of the working chambers leakage tightness, increasing of system reliability and durability, and improvement of compressor performance
(Continued)

related to bleeding and the dynamic pneumatic process as a whole.

13 Claims, 8 Drawing Sheets

(51) Int. Cl.

| | |
|---|---|
| ***F01C 19/10*** | (2006.01) |
| ***F03C 4/00*** | (2006.01) |
| ***F04C 2/00*** | (2006.01) |
| ***F04C 18/00*** | (2006.01) |
| ***F04C 18/22*** | (2006.01) |
| ***F04C 27/00*** | (2006.01) |

(56) References Cited

U.S. PATENT DOCUMENTS

| | | | | |
|---|---|---|---|---|
| 3,887,311 | A * | 6/1975 | Louzecky | F01C 19/02 418/113 |
| 4,012,180 | A * | 3/1977 | Berkowitz | F01C 19/02 418/141 |

FOREIGN PATENT DOCUMENTS

| | | | |
|---|---|---|---|
| JP | 58-177575 | 11/1983 | |
| RU | 1814689 | 5/1993 | |
| RU | 2 338 071 | 11/2008 | |
| RU | 2 484 107 | 6/2013 | |
| RU | 2 535 307 | 12/2014 | |
| WO | WO2012/023916 A1 * | 2/2012 | F04C 18/02 |

OTHER PUBLICATIONS

Wrede et al.—Recent Status of Trochoidal Type Compressors for Heat Pumps in Germany—1986—International Compressor Engineering Conference, Paper 530. https://docs.lib.purdue.edu/icec/530 (Year: 1986).*

RU2484107C1—Sleptsova et al.—Polymer Composition for Tribotechnical Purposes—Jun. 10, 2013—the English Machine Translation (Year: 2013).*

DE2521049A1—Wildner, Leander—Radial seal for rotary e.g. trochoidal piston—comprises two parts urged apart axially to provide axial sealing—Nov. 25, 1976—the English Machine Translation. (Year: 1976).*

International Search Report issued in PCT/RU2019/000049 dated Oct. 17, 2019 (1 page).

Written Opinion of the International Searching Authority issued in PCT/RU2019/000049 dated Oct. 17, 2019 (4 pages).

Wrede, F et al.: "Recent Status of Trochoidal Type Compressors for Heat Pumps in Germany", International Compressor Engineering Conference, Paper 530, 1986, XP055726576, Retrieved from the Internet.

* cited by examiner

SEALING SYSTEM FOR A ROTARY-PISTON COMPRESSOR

This application is the U.S. national phase of International Application No. PCT/RU2019/000049 filed Jan. 28, 2019 which designated the U.S., the entire contents of which are hereby incorporated by reference.

FIELD OF THE INVENTION

The invention relates to the sealing system for the air' and refrigerator rotary piston compressors and for the heat' and vacuum rotary piston pumps.

BACKGROUND

The prior art discloses the rotary piston compressor comprising an epitrochoid body with the frontal and rear side covers and a rotor located on an eccentric shaft. The rotor contains sealing cylinders (slide blocks) and the radial and butt sealing bars that are tightened against the side cover working surfaces by expanders (leaf springs) and seal the variable capacity working chambers formed by the body, the side covers and the rotor (RU 2535307 C2, publ. Oct. 12, 2014).

The disadvantage of this device is its sealing system design. The butt sealing bars and the cylindrical sealing system slide blocks are configured as individual separated parts, and the sealing elements are pressed by expanders which are configured as individual separated metal parts too. The use of separated seals and separated expanders results in reduced operating efficiency of the same, makes the process of their close assembly difficult and time-consuming, reduces the leak tightness of the working chambers and worsens the compressor performance related to the bleeding and the dynamic pneumatic process as a whole.

A system of the rotary piston engine sealing is known that consists of the radial seal elements spring-driven to the body working surface and the butt seal elements spring-driven to the side covers (RU 2338071 C1, publ. Oct. 11, 2008).

The disadvantage of the solution is that the sealing bars and the cylinders (slide blocks) of the sealing system are configured as individual separated parts which reduces the butt seals operating efficiency owing to the bleeding that occurs between a sealing bar and a shear block; this worsens the leak tightness of the compressor rotor butt seal system which results in the bleeding and the development of the dynamic pneumatic process as a whole. This being the case, the sealing elements are pressed by the expanders which are configured as separated parts as well, require the difficult and time-consuming precise assembly process, are not secured in the rotor slots and can fall out and get lost during the rotor disassembly, which causes various in-service problems.

Also, the prior art discloses a rotary piston compressor sealing system comprising radial and butt sealing bars configured in the rotor slots, interacting with cylinders (slide blocks) and tightened against the working surfaces by expanders (Wrede, F. and Kruse, H., "Recent Status of Trochoidal Type Compressors for Heat Pumps in Germany" (1986). International Compressor Engineering Conference. Paper 530, http://docs.lib.purdue.edu/icec/530).

The disadvantage of the solution is that the butt sealing bars and the cylindrical sealing system slide blocks are configured as separated parts. During the rotary piston machine operation, a gap is formed between the slide blocks and the butt bars owing to the centrifugal and frictional forces generated during the rotor spinning; this results in the gas leakage through the gap opening at the leading rotor apex; also, the reactive force is generated that lifts the butt bar end which results in the gas leakage through the inner rotor groove surface. This being the case, the sealing elements are pressed by the expanders which are configured as separated parts as well, require the difficult and time-consuming precise assembly process, are not secured in the rotor slots and can fall out and get lost during the rotor disassembly, which causes various in-service problems. The use of separated seals and separated expanders results in reduced operating efficiency of the same, makes the process of their close assembly difficult and time-consuming, reduces the leak tightness of the working chambers and worsens the compressor performance related to the bleeding and the dynamic pneumatic process as a whole.

The claimed invention obviates the above shortcomings.

DISCLOSURE OF THE INVENTION

The technical problem to be solved by the claimed invention is the creation of a reliable rotary piston compressor sealing system which would be characterized by an improved operating efficiency, would not require difficult and time-consuming assembly and maintenance works and would improve the compressor performance related to the leak tightness and the dynamic pneumatic process as a whole.

The technical result consists in the increasing of the efficiency of the sealing system' and the whole compressor operation, simplification of the system production process, simplification and labor intensity reduction of the system assembly and maintenance process, increasing of the working chambers leakage tightness, increasing of the system reliability and durability and improvement of the compressor performance related to the bleeding and the dynamic pneumatic process as a whole.

The technical result is achieved due to the fact that the rotary piston compressor sealing system comprises the radial and butt sealing bars configured in the rotor slots, tightened against the working surfaces by expanders and interacting with the sealing cylinders wherein the radial and butt sealing bars are made from antifriction composite material and each of the sealing cylinders is configured conjointly with one of the ends of one butt sealing bar.

The rotary piston compressor sealing system comprises the radial and butt sealing bars configured in the rotor slots, tightened against the working surfaces by expanders and interacting with the sealing cylinders wherein the radial and butt sealing bars are made from antifriction composite material and each of the sealing cylinder expander is configured conjointly with one of the ends of one butt sealing bar expander and also conjointly with one of the ends of one radial sealing bar expander.

Each of the radial sealing bar expanders is configured orthogonally to the butt sealing bar expander and has a slot.

Numbers in the Figures indicate the following items:

1—radial sealing bar;
2—butt sealing bar;
3—sealing cylinder;
4—expander for the butt sealing bar;
5—expander for the sealing cylinder;
6—expander for the radial sealing bar;
7—slot made in the expander for the radial sealing bar;
8—direction of the reactive force lifting the end of the sealing bar;
9—direction of the gas leakage through the gap located at the inner rotor slot surface;
10—direction of the gas leakage towards under the seal;
11—direction of the gas leakage into the slot through its outer surface;
12—outer surface of the rotor slot;
13—inner surface of the rotor slot;
14—direction of the gas leakage through the gap opening at the leading rotor apex;
15—direction of the friction force.

EMBODIMENTS OF THE INVENTION

Figure 1:
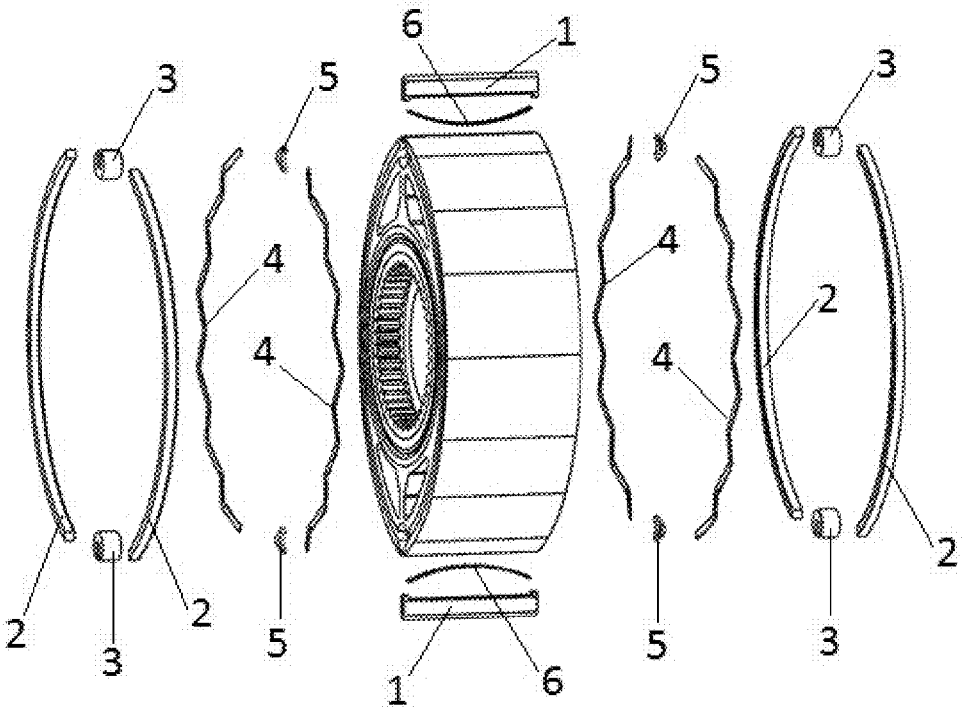
FIG. 1. Dismantled rotary piston compressor sealing system (analogue)
Figure 2:
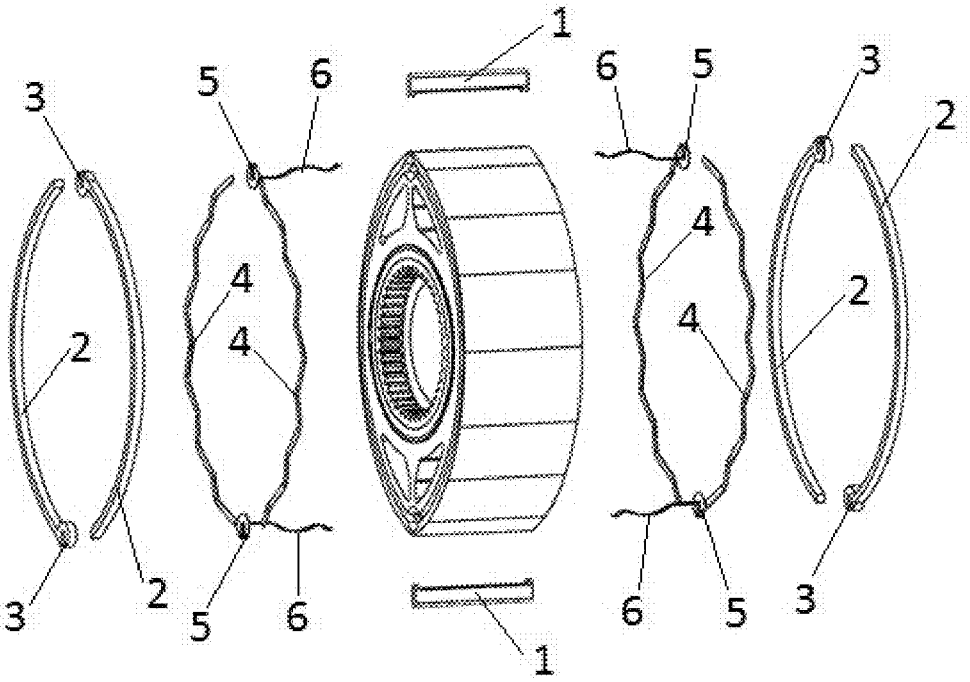
FIG. 2. Dismantled rotary piston compressor sealing system of the claimed invention.
Figure 3:
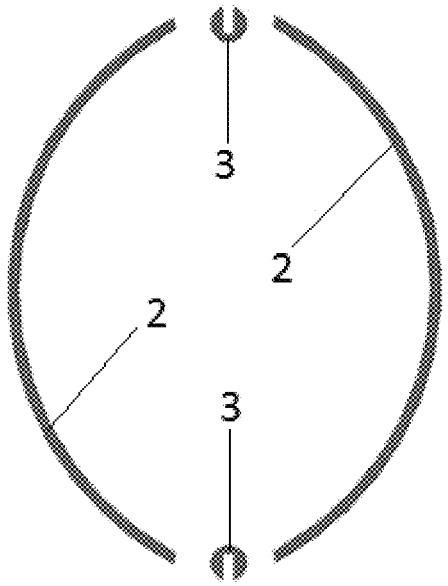
FIG. 3. Butt sealing bars configured separately from the sealing cylinders (analogue)
Figure 4:
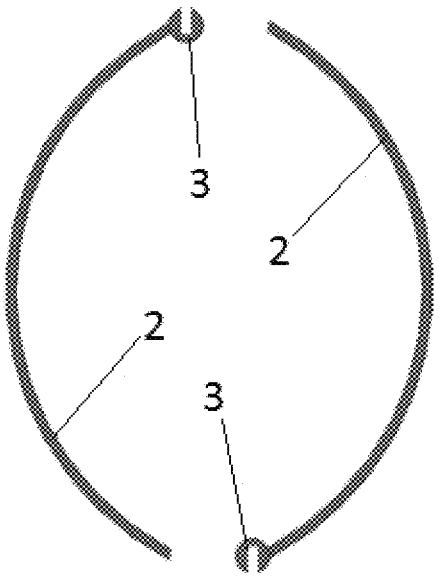
FIG. 4. Butt sealing bars of the claimed invention configured conjointly with the sealing cylinders.

The claimed invention is based on the fact that, unlike in the known solutions where the rotor sealing elements and the expanders (the elastic elements tightening the sealing elements towards the working surfaces of the machine body) are configured as individual separated pars (FIG. 1, 3, 6), the sealing elements of the claimed solution (namely, the butt seals in the form of «bars» and the cylinders) and the expanders are combined, i.e., configured as an integral unit (FIG. 2, 4, 7, 8, 9).

The rotary piston compressor sealing system comprises the radial 1 and butt 2 sealing bars configured in the rotor radial slots, at the butt areas and at the rotor apexes; the same sealing bars interacting with the cylinders 3; the said sealing system also comprises the elastic elements (expanders) located under the respective sealing bars and tightening the sealing elements against the working surfaces of the compressor and ensuring the working chambers sealing by pressing the sealing bars.

Each of the sealing cylinders 3 is configured conjointly with one of the ends (with the leading end) of the butt sealing bar 2 (FIG. 2, 4, 9). That is, one butt sealing bar 2 and one sealing cylinder 3 are configured as coincident ones in the rotor leading apex and form one part. Two such parts are installed at each rotor butt side, in its slots (FIG. 2). Such configuration provides for an easy, proper and not time-consuming system assembly, as well as simplifies the fabrication and maintenance of the system.

The radial 1 and butt 2 sealing bars are made from an antifriction composite material (e.g., from carbon fiber reinforced plastics/fluoropolymer composites or carbon containing composites and boron containing composites) by, e.g., hot extrusion, compaction or moulding.

Figure 5:
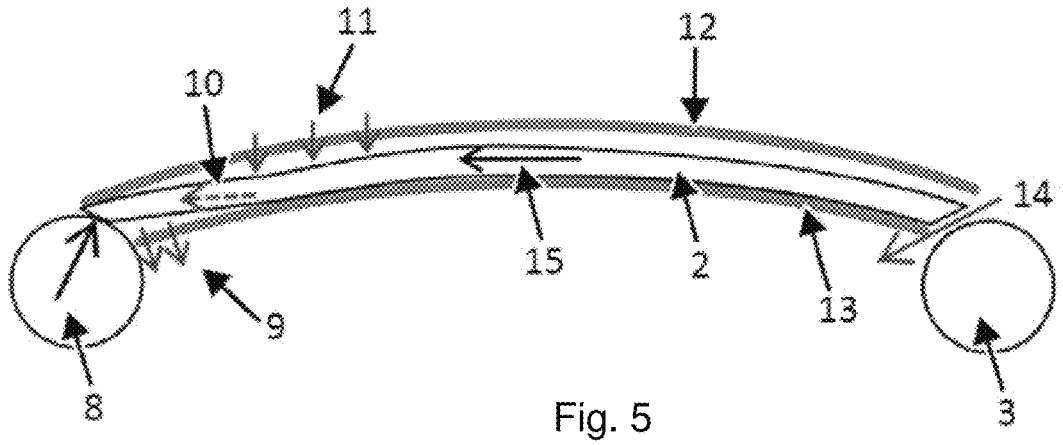
Fig. 5 (Prior Art)
FIG. 5. Schematic view of the gas leakages occurring in the process of the butt sealing bar operation, the same bar being configured separately from the sealing cylinder (analogue)

FIG. 5 shows the gas leakages characteristic of the known solutions, that occur in the process of the rotor and its butt sealing bar (configured separately from the sealing cylinder) operation. In the process of the rotor spinning, due to the centrifugal and frictional forces action, a gap is formed between the sealing cylinders and the butt sealing bars, which results in the gas leakage through the gap being formed at the leading rotor apex; and due to the reactive force action the end of the butt sealing bar is being lifted which results in the gas leakage through the gap, along the inner rotor groove surface.

Figure 5A:
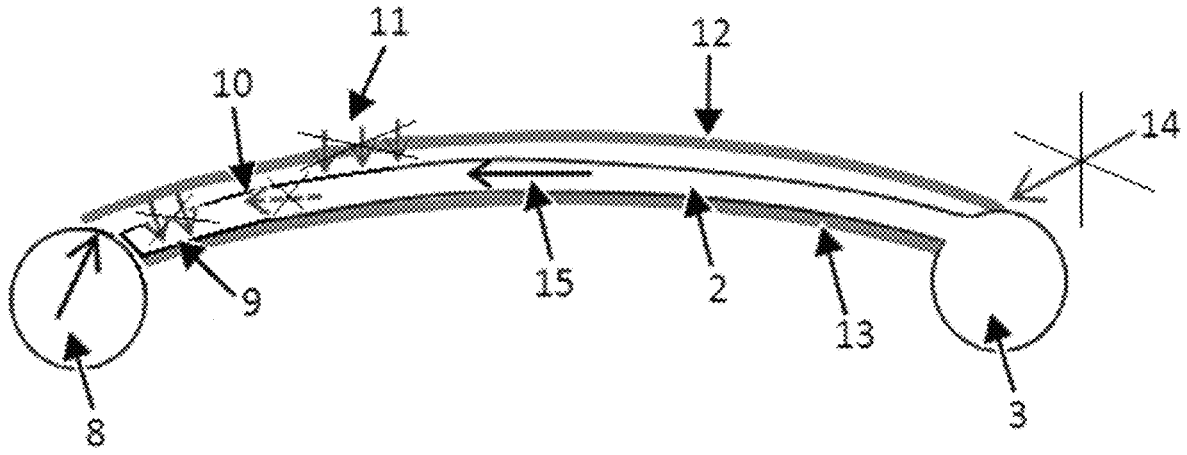
FIG. 5*a*. Schematic view of the gas leakages' absence in the process of the butt sealing bar operation, the same bar being configured conjointly with the sealing cylinder.
Figure 6:
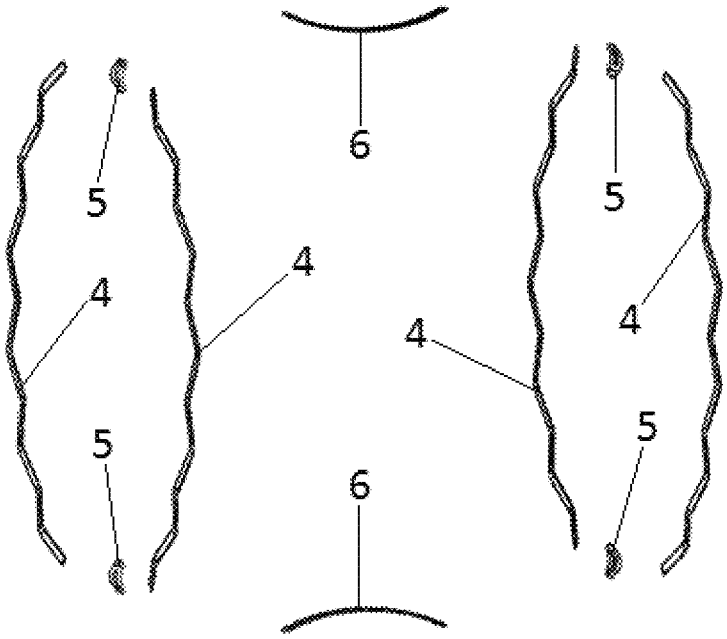
FIG. 6. Expander elements configured separately (analogue)

FIG. 5*a* shows how the close fit of the butt bar is secured and the formation of the gap between the butt bar and the sealing cylinder is avoided at the leading apex of the rotor owing to the conjunction of the butt bar 2 and the sealing cylinder 3, during the centrifugal and frictional forces action, due to the gas pressure; also, there is no gap along the inner groove surface and there is no reactive force that previously would lift the bar end and would cause the biggest leakage. That is, in comparison with the known solutions which would provide for a gap compensating the thermal expansion, the claimed solution provides for no gap at the leading sealing cylinder, which reduces the leakage volume and boosts the efficiency of operation both for the sealing system and for the compressor as a whole.

The use of an antifriction composite material additionally improves the butt seals operating efficiency and the compressor performance related to the bleeding and the dynamic pneumatic process as a whole.

The tightening of the sealing elements against the working surfaces is effected by the expanders located under the respective sealing elements and made from undulating spring steel by, e.g., forging or bending.

Every expander 5 for the sealing cylinder 3 is configured conjointly with one of the ends of one expander 4 intended for the butt sealing bar 2 and also with one of the ends of one expander 6 intended for the radial sealing bar 1 (FIG. 2, 7, 8, 9). That is, the expander 5 for the sealing cylinder 3, the expander 4 for the butt sealing bar 2 and the expander 6 for the radial sealing bar 1, connected together, form one part. Two such parts are installed at each rotor butt side, in its slots 21, 23. While assembling the system and installing each such part into the rotor slots 21, 23, each expander 5 for the sealing cylinder and each expander 4 for the butt sealing bar are installed into butt slots 21 and each expander 6 for the radial sealing bar 1 is simultaneously installed into the radial slot 23. In the process, during the installation of all four expander parts, two expanders 6 are arranged (one above the other) in each of the two radial rotor slots.

The expanders, configured separately (as e.g. in the known solutions), are capable of slipping (moving around) in the rotor slots under the sealing elements while the rotor spins; this results in a non-uniform sealing elements tightening against the working surfaces, an insufficient working chamber sealing and a premature and non-uniform sealing elements abrasion (FIG. 1, 6).

Figure 7:
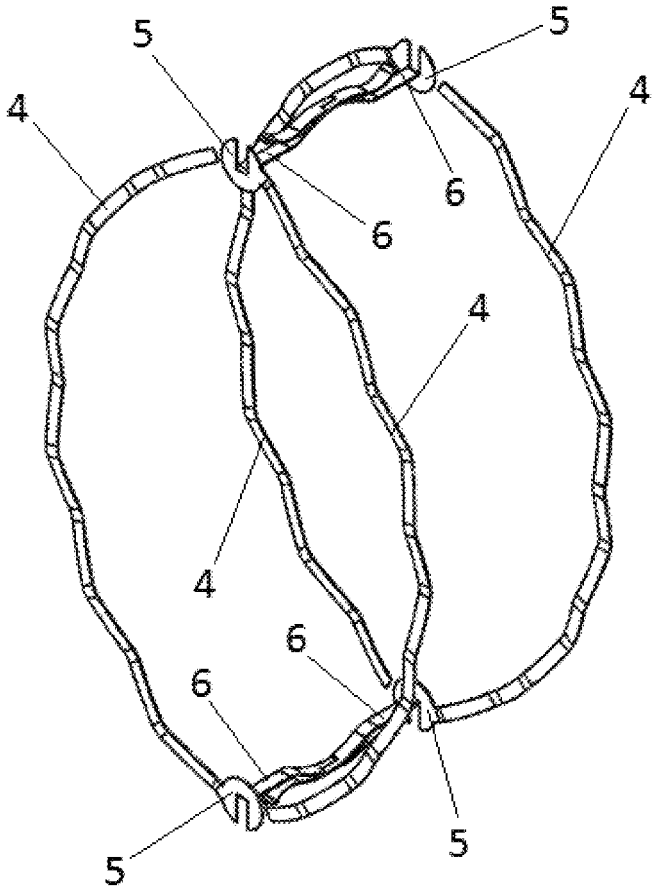
FIG. 7. Overview of the assembled expander elements of the claimed invention, configured conjointly.
Figure 8:
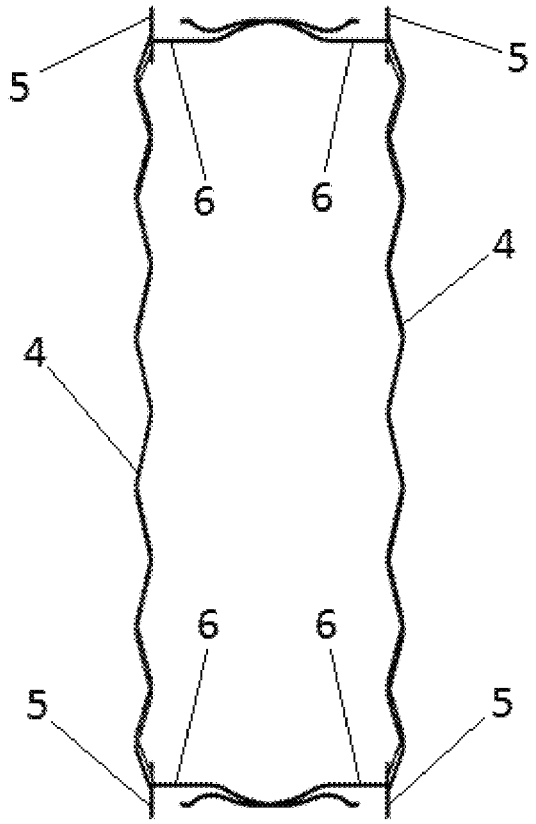
FIG. 8. Side view of the assembled expander elements of the claimed invention, configured conjointly.
Figure 9:
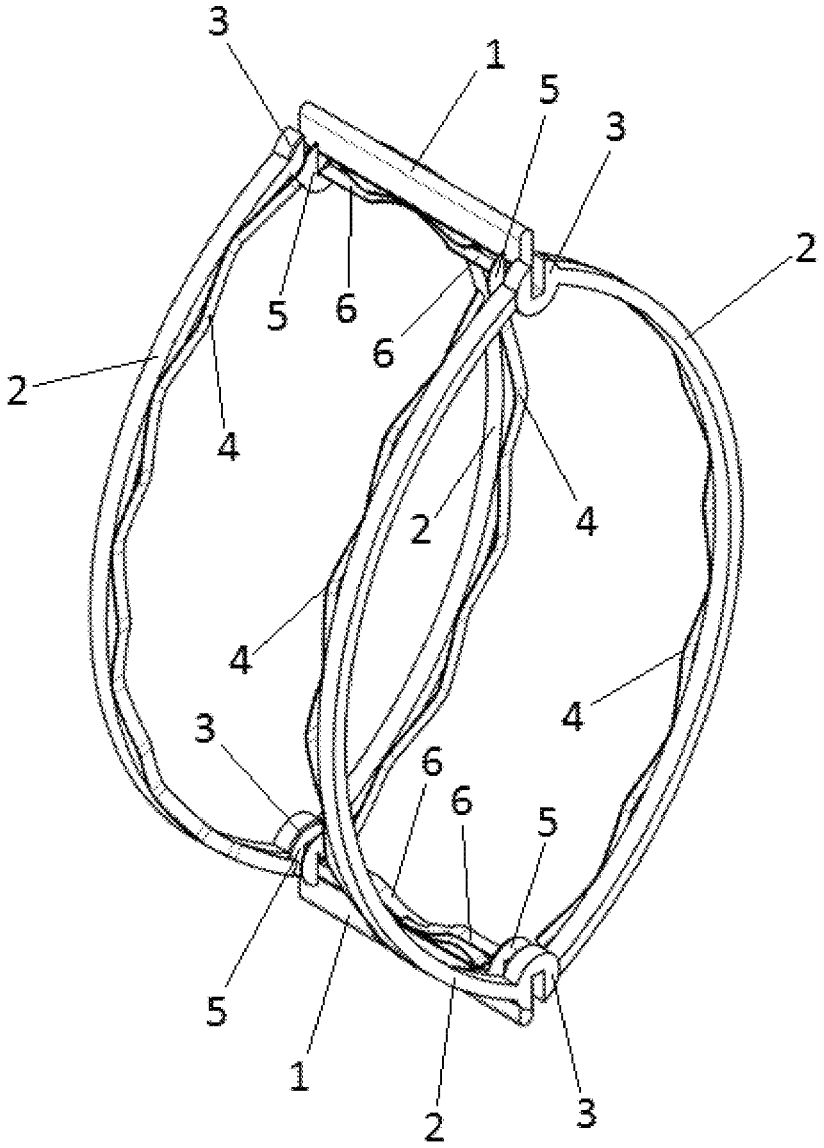
FIG. 9. Overview of the assembled seal' and expander elements of the claimed invention, configured conjointly.
Figure 10:
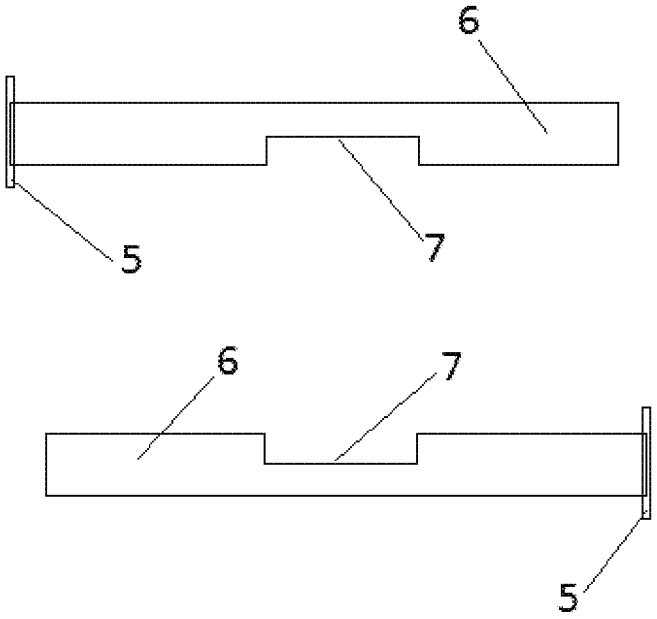
FIG. 10. Expanders for the radial sealing bars of the claimed invention, configured with a slot.

Each of the expanders 6 for the radial sealing bar 1 is configured orthogonally to each of the expanders 4 for the butt sealing bar 2 and has a slot 7 (open indentation), e.g., rectangular, that is arranged along the long edge and, predominantly, in the center of the expander 6 and is intended for a reliable fixation of the expanders 6 between each other (FIG. 7, 8, 10, 11).

Figure 11:
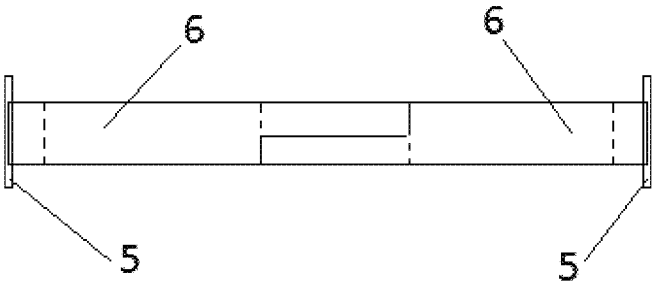
FIG. 11. Lap jointed expanders for the radial sealing bars of the claimed invention.

When expanders are installed into the rotor slots, the expanders 6 for the radial sealing bar are installed overlapped, owing to the slots; thus, the expanders interlock and form a reliable connection (FIG. 11).

Such expander configuration provides not only for a uniform, proper and reliable pressing of the sealing elements against the working surfaces, but also for an easy and not time-consuming system assembly, as well as for an easy system maintenance improving its reliability and durability.

Unlike the analogues with the sealing system consisting of twenty elements, the system of the claimed solution consists of ten elements which provides for an easy and not time-consuming system assembly and simplifies its maintenance.

The rotary piston compressor sealing system operates as follows.

Figure 12:
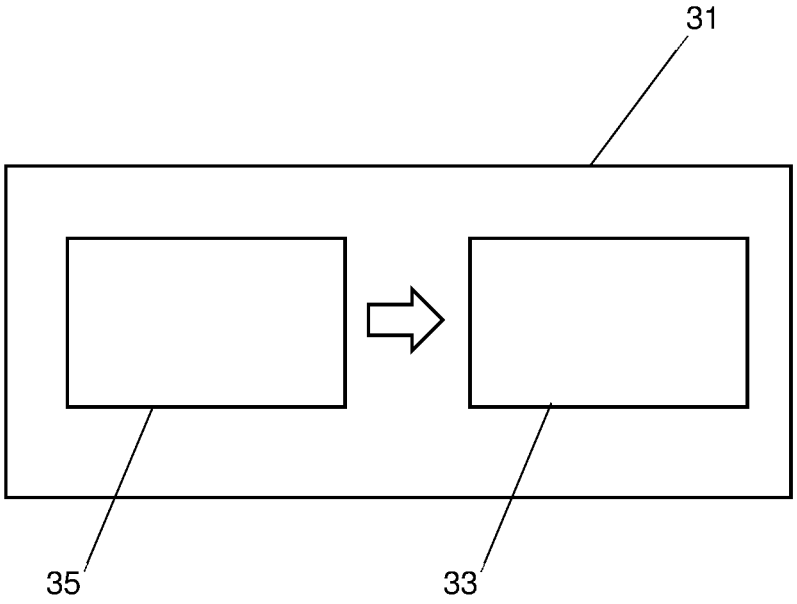
FIG. 12. A schematic view of a rotary piston compressor.

FIG. 12 is a schematic view of a rotary piston compressor 31. The eccentric shaft 33 rotates being driven by the engine shaft 35. The rotation is transferred from the eccentric shaft 33 to the rotor which executes a planetary motion rotating together with the shaft and spinning relative to it. While the rotor spins, the volume of the working chambers cyclically changes from a minimum to a maximum one owing to which the working process is executed. During the rotor spinning each sealing bar tightly presses against its working surface under the action of its spring-assisted element (expander). In the process, in comparison with the known solutions where the sealing and pressing elements are configured as individual separated parts and where, consequently, a gap is formed between the sealing cylinders and butt sealing bars due to the centrifugal and frictional forces action during the rotary piston machine operation which results in the gas leakage through the opening gap at the leading rotor apex (and the end of the butt sealing bar is lifted due to the reactive force action which results in the gas leakage through the gap along the inner rotor groove surface), the claimed solution is characterized by the absence of such gaps due to the butt sealing bar and the sealing cylinder being configured conjointly with one another and to their proper, reliable and constant pressing against the working surfaces with the help of the expanders the elements of which are configured conjointly; accordingly, no gas leakages occur in the latter case which results in an increased efficiency of the sealing system operation, an increased working chambers leakage tightness and an improved compressor performance related to the bleeding and the dynamic pneumatic process as a whole.

The invention claimed is:

1. A rotary piston compressor sealing system comprising radial sealing bars and butt sealing bars configured in rotor slots, tightened towards working surfaces by radial and butt sealing bar expanders and interacting with sealing cylinders, wherein the radial sealing bars and butt sealing bars are made from an antifriction composite material and each sealing cylinder expander is configured conjointly with one of the ends of one butt sealing bar expander and also conjointly with one of the ends of one radial sealing bar expander, and wherein each of the radial sealing bar expanders is configured orthogonally to the at least one butt sealing bar expander and has a slot.

2. The rotary piston compressor sealing system of claim 1, wherein the radial and butt sealing bar expanders are elastic elements.

3. The rotary piston compressor sealing system of claim 2, wherein the radial and butt sealing bar expanders are located under respective ones of the radial sealing bars and the butt sealing bars.

4. The rotary piston compressor sealing system of claim 1, wherein the antifriction composite material is a carbon fiber reinforced plastic.

5. The rotary piston compressor sealing system of claim 1, wherein the antifriction composite material is a fluoropolymer composite, carbon containing composite, or boron containing composite.

6. The rotary piston compressor sealing system of claim 1, wherein the butt sealing bars are fitted against the sealing cylinders such that gapping is avoided at least at a leading location of a rotor of a rotary piston compressor.

7. The rotary piston compressor sealing system of claim 1, wherein one of the sealing cylinders is a leading sealing cylinder that lacks a gap adjacent thereto.

8. The rotary piston compressor sealing system of claim 1, wherein the slot of each of the radial sealing bar expanders is rectangular.

9. The rotary piston compressor sealing system of claim 1, wherein the slot of each of the radial sealing bar expanders is arranged along a long edge of the respective radial sealing bar expander.

10. The rotary piston compressor sealing system of claim 1, wherein the slot of each of the radial sealing bar expanders is configured as an indentation in the respective radial sealing bar expander.

11. A rotary piston compressor comprising the rotary piston compressor sealing system of claim 1.

12. The rotary piston compressor of claim 11, further comprising an eccentric shaft that is rotatable while being driven by an engine shaft.

13. The rotary piston compressor of claim 12, wherein the butt sealing bars and sealing cylinders constantly press against the working surfaces when the rotary piston compressor is operated.

* * * * *